US005375357A

United States Patent [19]

Butcher et al.

[11] Patent Number: 5,375,357

[45] Date of Patent: Dec. 27, 1994

[54] VIEWING POSITION ADJUSTABLE TICKET HOLDER

[75] Inventors: Paul J. Butcher, Erie; William R. Burrows, IV, Fairview, both of Pa.

[73] Assignee: Yates Company, Erie, Pa.

[21] Appl. No.: 68,854

[22] Filed: May 28, 1993

[51] Int. Cl.[5] ..... G09F 03/18

[52] U.S. Cl. ..... 40/642; 248/296; 248/279; 248/220.2

[58] Field of Search ..... 403/106, 107, 97; 248/296, 279, 286, 220.2; 40/5, 640, 650, 654

[56] References Cited

U.S. PATENT DOCUMENTS

| | | | |
|---|---|---|---|
| 2,787,433 | 4/1957 | Slavsky et al. | 248/204 |
| 2,830,394 | 4/1958 | Gordon et al. | 40/10 |
| 2,981,018 | 4/1961 | Hopp et al. | 40/16 |
| 3,582,170 | 6/1971 | Schaeffer et al. | 312/140.4 |
| 4,295,288 | 10/1981 | Westberg | 40/16.4 |
| 4,334,372 | 6/1982 | Colmar | 40/650 |
| 4,557,064 | 12/1985 | Thompson | 40/10 |
| 4,745,695 | 5/1988 | Hetzer | 40/10 |
| 4,881,707 | 11/1989 | Garfinkle | 40/642 |
| 4,909,464 | 3/1990 | Levine et al. | 248/225.1 |
| 5,044,104 | 9/1991 | Hopperdietzel | 40/642 |
| 5,111,606 | 5/1992 | Reynolds | 40/642 |

FOREIGN PATENT DOCUMENTS

| | | | |
|---|---|---|---|
| 0243653 | 11/1965 | Austria . | |
| 0759737 | 5/1967 | Canada | 40/650 |
| 0120099 | 3/1983 | European Pat. Off. . | |
| 3513199 | 10/1986 | Germany . | |
| 3513234 | 10/1986 | Germany . | |
| 3515474 | 10/1986 | Germany . | |
| 6263229 | 7/1962 | Switzerland | 40/51 |
| 2207539 | 1/1989 | United Kingdom . | |

*Primary Examiner*—Edward K. Look
*Assistant Examiner*—Mark Sgantizos
*Attorney, Agent, or Firm*—Lovercheck and Lovercheck

[57] ABSTRACT

A ticket mounting apparatus which includes a bracket for attaching the ticket support to a shelf or the like. The mounting apparatus includes a structure to permit the label to be mounted in several selected positions. The mounting apparatus is made up of a C-shaped outer member having internal teeth and a slot. A cylindrical C-shaped inner member having external teeth is received in the C-shaped member and a bracket attached to the C-shaped inner member and extends through the slot and can be attached to a bracket holder. The C-shaped outer member can be attached to a support and the bracket can extend out of the slot so that the ticket holder can be swung up and down with the cylindrical member.

7 Claims, 2 Drawing Sheets

VIEWING POSITION ADJUSTABLE TICKET HOLDER

BACKGROUND OF THE INVENTION

The present invention relates to an apparatus for mounting tickets or labels and more particularly to the general type that includes a carrier for changeable information tickets or other documents and a fastening means for fastening the carrier to the edge of a support, such as a shelf, container, or the like.

Applicant is aware of the following U.S. Patents:

U.S. Pat. No. 2,787,433 to Slavsky, et al for a self-stopping hinged sign.

U.S. Pat. No. 2,830,394 to Gordon, et al for a display card holder.

U.S. Pat. No. 2,981,018 to Hopp, et al for an item indicating device.

U.S. Pat. No. 3,582,170 to Schaeffer, et al for a display table.

U.S. Pat. No. 4,295,288 to Westberg for a holder for information carriers in strip form.

U.S. Pat. No. 4,557,064 to Thompson for a featured price card holder.

U.S. Pat. No. 4,745,695 to Hetzer for an information carrier holding rail.

U.S. Pat. No. 4,909,464 to Levine, et al for a deflectable price channel-mounted sign holder.

U.S. Pat. No. 5,044,104 to Hopperdietzel for a label mounting apparatus. 5,111,606 to Reynolds for an at-shelf lighted merchandising display.

Applicant is also aware of Austria Patent No. 243,653; European Patent No. 120,099; German Patent Nos. DE 3,513,199 A1; 3,513,234 A1 and 3,515,474 A1 and United Kingdom Patent No. 2,207,539 A.

SUMMARY OF THE INVENTION

The carrier of the present invention is made up generally of a cylindrical C-shaped inner member which has external teeth fixed to the outer periphery thereof. The carrier is fixed to a mounting bracket and has a suitable label support on it. A C-shaped outer member with internal teeth receives the external teeth on the cylindrical member. The C-shaped members are made of resilient material so that several of the internal teeth on the C-shaped outer member will engage several of the external teeth on the cylindrical member at all times to hold the mounting bracket in selected angular positions, relative to the support. Both the internal teeth and the external teeth have cylindrical tips. The internal teeth slide over the external part of the cylindrical part of the external teeth, when a greater than usual vertical force is applied to the label support. The C-shaped member internal tooth engages the external teeth of the inner C-shaped member over more than 180 degrees of the circumference of the inner C-shaped members.

Prior art such as shown in U.S. Pat. Nos. 4,557,064 and U.S. Pat. No. 5,044,104 show ticket holders wherein single external teeth engage internal teeth.

It is an object of the present invention to provide a viewing position adjustable document holder that is simple in construction, economical to manufacture and simple and efficient to use.

It is another object of the invention to provide an improved viewing position adjustable document holder, Another object of the invention is to provide a document holder that utilizes two concentric cylindrical members for adjustment.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S).

DESCRIPTION OF THE PREFERRED EMBODIMENT(S)

Figure 1:
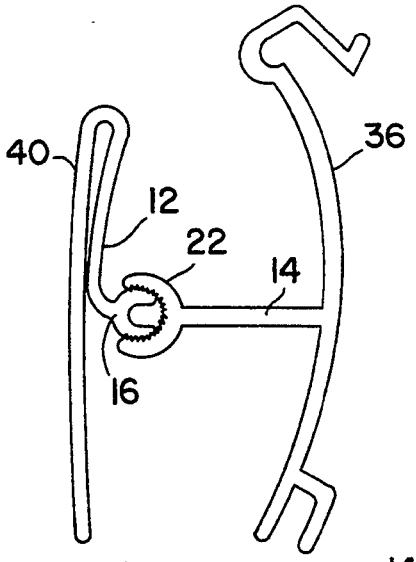
FIG. 1 is a side view of the document holder.
Figure 3:
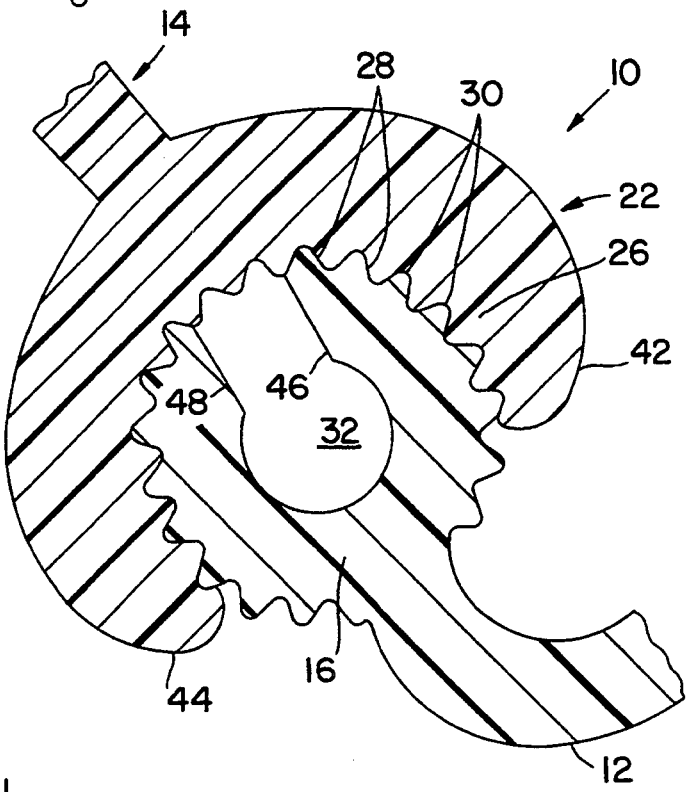
FIG. 3 is a cross sectional view taken on line 3—3 of FIG. 2.

Now with more particular reference to the drawing, FIG. 1 shows document support 10 is generally made up of molding member 36 and document holder 40. Molding member 36 and document holder 40 may be of a well known type such as shown in U.S. Pat. No. 5,044,104, suitable to support a ticket label or other document.

Document holder 40 is adjustably supported on molding member 36 by bracket 12 which is integrally attached to inner C-shaped cylindrical member 16 and integrally attached to document holder 40. Outer C-shaped cylindrical member 22 is integrally attached to molding member 36 by bracket 14.

Inner C-shaped cylindrical member 16 has central bore 32 connected to the outer periphery of radially extending slot 47. Slot 47 is bounded by sides 46,48. External teeth 30 are integrally attached to the cylindrical outer periphery of inner C-shaped cylindrical member 16. External teeth 30 and internal teeth 28 have cylindrical shaped tips.

Outer C-shaped cylindrical member 22 has open side 26 and internal teeth 28 on its cylindrical inner periphery. Bracket 12 can be swung with inner C-shaped cylindrical member 16 from first end 42 of outer C-shaped cylindrical member 22 to second end 44 of outer C-shaped cylindrical member 22.

Both inner C-shaped cylindrical member 16 and outer C-shaped cylindrical member 22 are made of resilient material. To adjust document holder 40 up and down, the operator will exert an up or a down force on document holder 40. This force will apply a torsional force to outer C-shaped cylindrical member 22. Internal teeth 28 will tend to ride up over external teeth 30 due to the torsional force. This will spread outer C-shaped cylindrical member 22, allowing it to rotate in relation to inner C-shaped cylindrical member 16.

Figure 2:
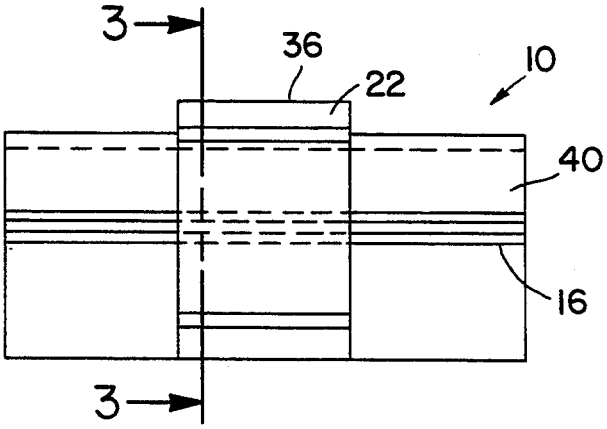
FIG. 2 is front view of the document holder according to the invention.
Figure 4:
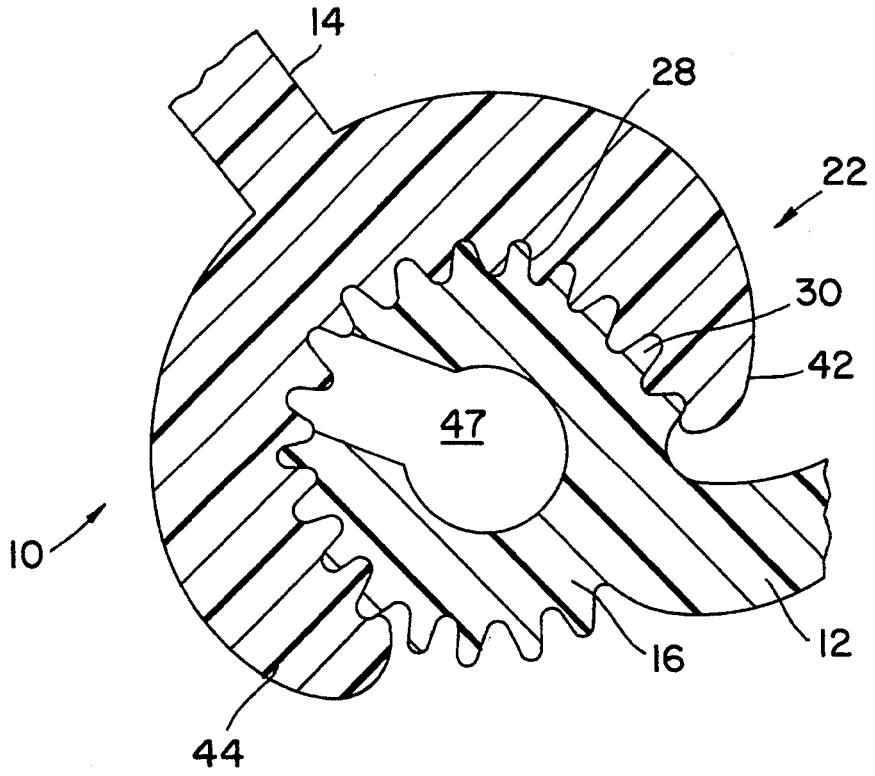
FIG. 4 is a cross sectional view similar to FIG. 3, with the document holder swung to a second position.

As shown in FIG. 2, inner member 16 is substantially longer than outer member 22 whereby inner member 16 can slide laterally along outer member 22 to adjust document holder 40 to lateral positions. Outer member 22 receives inner member 16 with internal teeth 28 engaging external teeth 30 around more than one-hundred-and-eighty degrees of the circumference of inner member 16.

Slot 47 allows sides 46,48 to move toward one another more radially and also eliminates external teeth 30 at that position thereby improving the action of the relative mounting of outer member 22 and the inner member 16.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. An apparatus for mounting a changeable document on a document holder comprising a molding member and a C-shaped outer member fixed to said molding member;

said outer member having a generally cylindrical inside periphery and an open side;

internal teeth on said inside periphery of said outer member;

a generally cylindrical C-shaped inner member having external teeth;

said outer member being made of resilient material;

said inner member being received in said outer member with said internal teeth engaging said external teeth;

a bracket fixed to said inner member and extending through said open side of said outer member;

said bracket being attached to said document holder to rotate said inner member on said outer member wherein said document holder can be adjusted up and down;

said inner member has a central bore concentric thereto; and, a slot in said inner member extending from said central bore to the outer periphery thereof, whereby said inner member can be deflected closing said slot slightly allowing said external teeth to slide over said internal teeth for adjusting said document holder.

2. The apparatus recited in claim 1 wherein said inner member is substantially longer than said outer member whereby said inner member can slide laterally along said outer member to adjust said document holder to lateral positions.

3. The apparatus recited in claim 1 wherein said bracket is attached to said inner member at the side opposite said slot.

4. The apparatus recited in claim 1 wherein said internal teeth and said external teeth have cylindrical tips.

5. The apparatus recited in claim 4 wherein said document holder is integrally attached to said inner member.

6. The apparatus recited in claim 5 wherein said outer member is integrally attached to said molding member by a bracket; and, said bracket of said document holder extends adjacent said open side of said outer member.

7. An apparatus for supporting a changeable document comprising;

a document holder;

a molding member;

a C-shaped inner member fixed to said document holder;

a C-shaped outer member fixed to said molding member;

internal teeth on said outer member;

external teeth on said inner member;

said outer member receiving said inner member with said internal teeth engaging said external teeth around more than one-hundred-and-eighty degrees of the circumference of said inner member; and, said internal teeth having cylindrical tip surfaces whereby said internal teeth slide over said external teeth when an external force is exerted on said document holder;

said inner member has a central bore concentric thereto; and, a slot in said inner member extending from said central bore to the outer periphery thereof, whereby said inner member can be deflected closing said slot slightly allowing said external teeth to slide over said internal teeth for adjusting said document holder.

* * * * *